United States Patent [19]

Braun

[11] Patent Number: 4,773,578

[45] Date of Patent: Sep. 27, 1988

[54] DART CARRYING CASE

[76] Inventor: Richard A. Braun, 706 Irene Ave., Fort Wayne, Ind. 46808

[21] Appl. No.: 55,416

[22] Filed: May 29, 1987

[51] Int. Cl.[4] ..... A45F 5/00

[52] U.S. Cl. ..... 224/252; 206/315.1; 224/916

[58] Field of Search ..... 206/315.1, 523, 592, 206/443; 224/252, 253, 916, 918, 235, 240, 242; 220/8, 306, 315; 273/416

[56] References Cited

U.S. PATENT DOCUMENTS

| | | | |
|---|---|---|---|
| 1,627,145 | 5/1927 | Breed | 224/252 X |
| 3,434,638 | 3/1969 | Beynon | 224/916 X |
| 3,454;151 | 7/1969 | Plaskan | 220/8 X |
| 3,960,271 | 6/1976 | Nelson | 206/315.1 |
| 4,185,748 | 1/1980 | Vache et al. | 220/8 |
| 4,387,805 | 6/1983 | Lanius | 224/916 X |
| 4,467,947 | 8/1984 | Minneman | 224/253 |
| 4,524,868 | 6/1985 | Buckley et al. | 206/523 X |

*Primary Examiner*—Henry J. Recla
*Assistant Examiner*—Robert Petrik
*Attorney, Agent, or Firm*—Roger M. Rickert

[57] ABSTRACT

A carrying case for conventional throwing darts is disclosed in the form of a plastic box and mating plastic cover. The box or tray has a pair of tabs extending from one side for attaching the tray to a dart player's belt and a cover latching tab or boss on the opposite side. The lid or cover includes open slots passing around the belt tabs so that the tray may be worn with or without the cover being in place and includes an opening which cooperates with the latching boss to hold the cover in place. The tray is filled with a resilient material into which darts may be stuck and supported freeing the player's hands while waiting his turn to throw. The tray has a flat bottom and may rest upright on a horizontal surface as an alternative to being worn by the player.

12 Claims, 1 Drawing Sheet

DART CARRYING CASE

SUMMARY OF THE INVENTION

The present invention relates generally to recreational or sporting goods accessories and in particular to a carrying and storage case for conventional throwing darts which may either rest on a horizontal surface or be worn by a dart player. In particular, the dart carrying case of the present invention may be clipped over a dart player's belt and darts inserted pointed end first so as to pierce a resilient material in the case to be there supported until withdrawn by the player. A removable lid or cover is provided for longer term storage and protection of the darts.

Belt supported arrangements for carrying a wide variety of objects including, in addition to the familiar holsters for hand guns and scabbards for knives, hammers (U.S. Pat. No. 3,294,298); golf tees (U.S. Pat. No. 1,627,145); hair clips (U.S. Pat. No. 3,342,387); and fish hooks (U.S. Pat. No. 4,281,470) have been devised. Each is peculiarly suited to the object to be carried and not adaptable to dissimilar objects.

Dart throwing is an old and familiar form of recreation and is increasing in popularity among more serious players in contests or tournaments. A conventional playing dart has an elongated sharp needle-like nose called the point connected to a properly weighted stem or hand grip portion called the body with feathers or plastic vanes similar to fletching on an arrow and referred to as the flight on the shaft near the rear of the dart for flight stabilization. Such darts are thrown at a relatively soft wood or fibre target board with various scoring sectors marked thereon and with several players taking turns throwing. While waiting a turn, players are somewhat inhibited in other activities because they need to either hold their darts or attempt to find a temporary storage location for their darts.

Among the several objects of the present invention may be noted the provision of a dart carrier which is readily fastened to and removed from a player's belt; the provision of a foam filled tray for receiving the pointed end of a dart; the provision of a scheme for protecting and storing darts; and the provision of a removable protective cover for a dart supporting carrier. These as well as other objects and advantageous features of the present invention will be in part apparent and in part pointed out hereinafter.

In general, a dart carrier to be worn by a dart player has a hollow openfaced tray, a block of resilient foam-like material within the tray for receiving and supporting at least one and typically three darts, and a pair of tabs along one tray edge for removably attaching the carrier to a player's belt. The tray may take the general form of a rectangular parallelepiped having an open top, a generally flat bottom wall and four pairwise parallel generally flat sidewalls.

Also in general and in one form of the invention, a two piece dart carrier includes a tray in the general form of a rectangular parallelepiped having an open top, a generally flat bottom wall and four pairwise parallel generally flat sidewalls; and a removable resilient inset of the same general size and shape as the tray received within the tray with one inset surface extending generally coextensive with the tray near the open face. The inset material is sufficiently pliable to be easily pierced by a pointed end of a dart and sufficiently resilient to grip an end portion of the dart holding the dart in position within the material.

BRIEF DESCRIPTION OF THE DRAWING

Corresponding reference characters indicate corresponding parts throughout the several views of the drawing.

Figure 1:
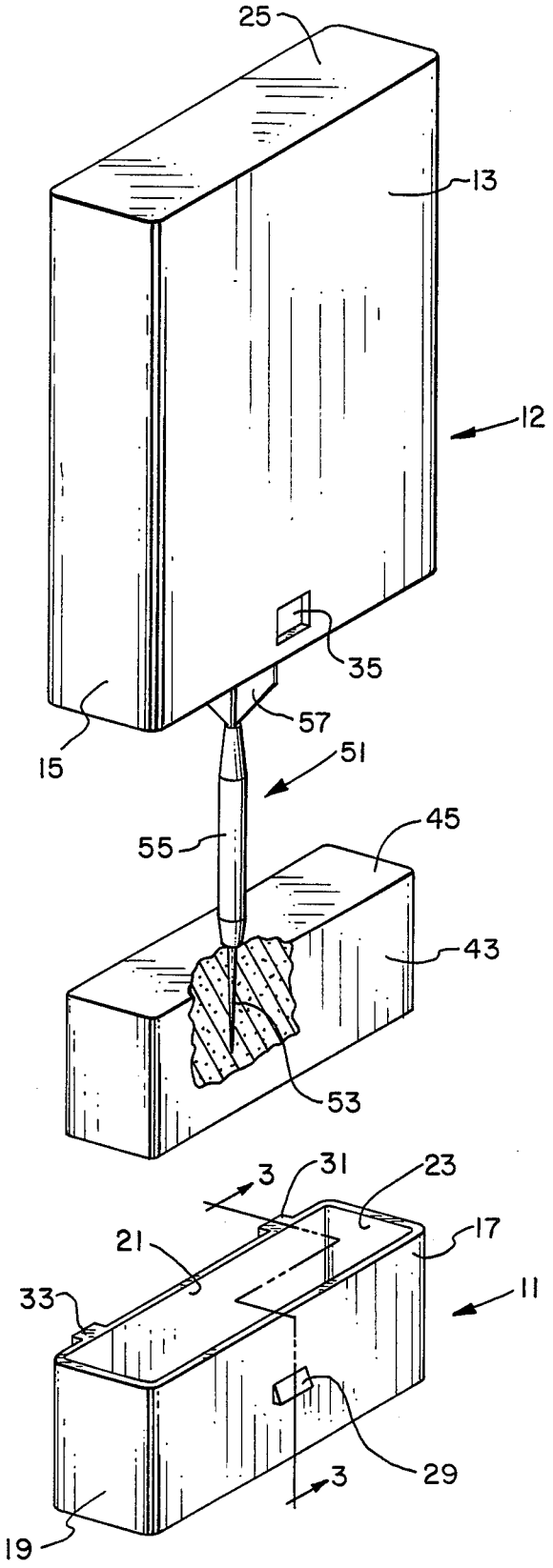
FIG. 1 is an exploded perspective view of the dart carrier of the present invention with an exemplary dart supported therein.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring now in greater detail to the accompanying drawing, a dart carrier includes a pair of hollow open-ended mateable rectangular parallelepipeds 11 and 12 each having four pairwise parallel generally flat sidewalls such as 13, 15, 17, 19, 21 and 23 along with one end wall 25 or 27. One of the pair (11) comprises a tray and the other (12) comprises a lid for the tray. The tray 11 includes a tapered latching boss 29 formed as a protruding nose integral with and extending from tray sidewall 17 along with integral tabs 31 and 33 extending from sidewall 21 for attaching the tray to a belt of a dart player. The pair of cantilevered tabs 31 and 33 extend from the tray sidewall 21 which is opposite and parallel to the sidewall 17 having the latching boss 29. The tabs are disposed close to and generally parallel to the tray wall 21 from which they extend forming a belt receiving gap 47 between sidewall 21 and the tabs 31 and 33. Thus, tabs 31 and 33 fit between the inside surface of the player's belt and his trousers when the carrier is worn by a player.

An exemplary dart 51 is shown supported in foam block 43. The point or needle-like end 53 of the dart pierces the foam with the body or stem portion 55 disposed above the surface 45 of the foam to be gripped for removing the dart when desired. The shaft and feathers or flight portion 57 near the rear of the dart are protected by lid 12 when that lid is closed on the tray as in FIG. 2.

Figure 2:
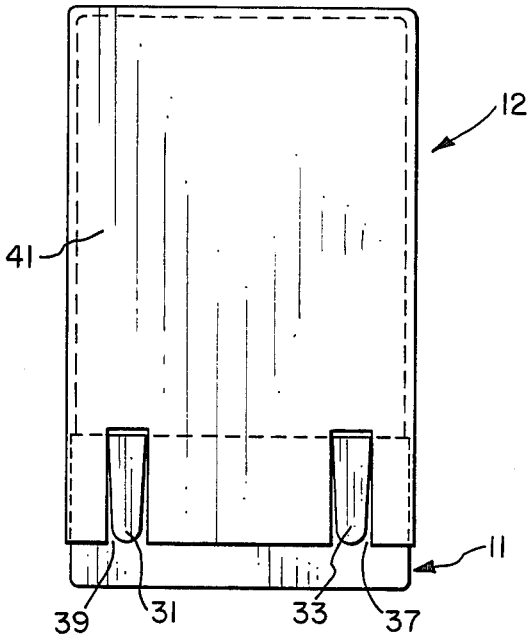
FIG. 2 is a rear plan view of the dart carrier of FIG. 1 with the lid in the closed position.

The lid 12 includes an opening 35 in sidewall 13 and open notches 37 and 39 in the opposite sidewall 41 which notches are alignable with the attaching tabs 31 and 33 (as best seen in FIG. 2) so that the lid may be passed downwardly over the open tray top with the open notches spanning the attaching tabs until the latching boss 29 engages the lid 12. Thereafter, the lid sidewall 13 and the tray sidewall 17 flex somewhat allowing the sidewall 13 of lid 12 to slide along the incline 49 of boss 29 until the boss slips into opening 35. Slight pressure on sidewall 17 flexes the boss 29 out of engagement with the opening 35 allowing the lid to be removed.

Figure 3:
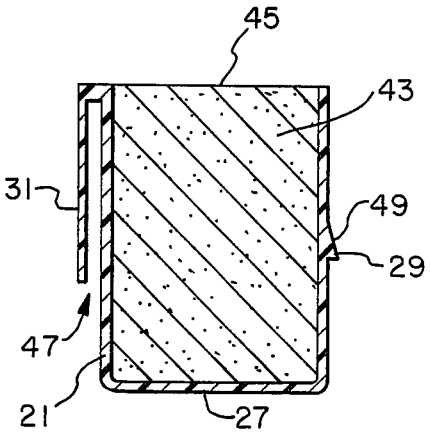
FIG. 3 is a view in cross-section along line 3—3 of FIG. 1.

A removable resilient inset 43 of the same general size and shape as the tray 11 is received within the tray as shown in FIG. 3 with one inset surface 45 extending generally coextensive with the tray near the open face. The inset material is sufficiently pliable to be easily pierced by a pointed end of a dart and sufficiently resilient to grip an end portion of the dart holding the dart in position with the dart point embedded within the material. PYRELL, an approximately two pound per cubic foot polyurethane foam material has been found suitable and is sufficiently pliable to be easily pierced by a pointed end of a dart and yet sufficiently resilient to grip the point end portion of the dart holding the dart in position within the material. The hole created by the dart tends to close when the dart is removed, however, with long use, the inset material may eventually need to be replaced. The inset 43 may be frictionally held in the tray 11 during normal use and is removable when such replacement is required by dimensioning the inset to fit tightly within the tray. At least one dimension of the inset may exceed the corresponding dimension of the tray so that the inset is slightly compressed when received within the tray. Of course, inset 43 could be permanently adhered to the inside surface of tray 11 if desired.

From the foregoing, it is now apparent that a novel dart carrying arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A dart carrier to be worn by a dart player comprising a hollow open-faced tray, a block of resilient foam-like material within the tray for receiving and supporting at least one dart, means along one tray edge for removably attaching the carrier to a player's belt, a hollow cover in the general form of a rectangular parallelepiped having an open bottom, a generally flat top wall and four pairwise parallel generally flat sidewalls adapted to be removably affixed to the tray to cover and protect at least one dart received within the block, a tapered latching boss formed integrally with and extending from one tray sidewall, the cover including an opening in a corresponding sidewall adapted to mate with the latching boss for holding the cover in position on the tray, and at least one open notch in a cover sidewall alignable with the means for removably attaching so that the cover may be passed downwardly over the open tray top with the open notch spanning the means for removably attaching until the latching boss engages the cover opening.

2. The dart carrier of claim 1 wherein the tray is in the general form of a rectangular parallelepiped having an open top, a generally flat bottom wall and four pairwise parallel generally flat sidewalls.

3. The dart carrier of claim 1 wherein the means for removably attaching comprises a pair of cantilevered tabs extending from the tray sidewall opposite the sidewall having the latching boss, the tabs lying close to and generally parallel to the tray wall from which they extend.

4. The dart carrier of claim 1 wherein the block comprises a removable resilient inset of the same general size and shape as the tray, and is received within the tray with one inset surface extending generally coextensive with the tray near the open face.

5. The dart carrier of claim 4 wherein the inset material is sufficiently pliable to be easily pierced by a pointed end of a dart and sufficiently resilient to grip an end portion of the dart holding the dart in position within the material.

6. A three piece dart carrier comprising:

a tray in the general form of a rectangular parallelepiped having an open top, a generally flat bottom wall and four pairwise parallel generally flat sidewalls;

a removable resilient inset of the same general size and shape as the tray received within the tray with one inset surface extending generally coextensive with the tray near the open face; and a hollow cover adapted to be removably affixed to the tray to cover and protect at least one dart received within the inset;

a tapered latching boss formed integrally with and extending from one tray sidewall, the cover including an opening adapted to mate with the latching boss for holding the cover in position on the tray; and means along one tray sidewall and near the open top for attaching the carrier to a dart player's belt, the cover further including open notch means alignable with the means for attaching so that the cover may be passed downwardly over the open tray top with the open notch means spanning the means for attaching until the latching boss engages the cover opening.

7. The dart carrier of claim 6 wherein the inset material is sufficiently pliable to be easily pierced by a pointed end of a dart and sufficiently resilient to grip an end portion of the dart holding the dart in position within the material.

8. The dart carrier of claim 6 wherein the means for attaching the carrier to a dart player's belt comprises a pair of cantilevered tabs extending from the tray sidewall opposite the sidewall having the latching boss, the tabs lying close to and generally parallel to the tray wall from which they extend.

9. A dart carrier comprising a pair of hollow open-ended mateable rectangular parallelepipeds each having four pairwise parallel generally flat sidewalls and one end wall, one of the pair comprising a tray and the other comprising a lid for the tray, the tray including a tapered latching boss formed integrally with and extending from one tray sidewall along with means for attaching the tray to a belt of a dart player comprising a pair of cantilevered tabs extending from the tray sidewall opposite the sidewall having the latching boss, the tabs lying close to and generally parallel to the tray wall from which they extend, the lid including an opening in one sidewall and open notch means in the opposite sidewall for receiving the means for attaching the carrier to a dart player's belt, the open notch means being alignable with the means for attaching so that the lid may be passed downwardly over the open tray top with the open notch means spanning the means for attaching until the latching boss engages the lid opening.

10. The dart carrier of claim 9 further comprising a removable resilient inset of the same general size and shape as the tray received within the tray with one inset surface extending generally coextensive with the tray near the open face, the inset material being sufficiently pliable to be easily pierced by a pointed end of a dart and sufficiently resilient to grip an end portion of the dart holding the dart in position within the material.

11. The dart carrier of claim 10 wherein at least one dimension of the inset exceeds the corresponding dimension of the tray so that the inset is slightly compressed when received within the tray.

12. In combination with a throwing dart of the type having an elongated sharp needle-like nose at one end, a shaft, and vanes on the shaft near the end of the shaft opposite the nose; a dart carrier to be worn by a dart player comprising a hollow open-faced tray, a block of resilient foam-like material within the tray for receiving and supporting at least one throwing dart, and means along one tray edge for removably attaching the carrier to a player's belt, the block comprising a removable resilient inset of the same general size and shape as the tray, and received within the tray with one inset surface extending generally coextensive with the tray near the open face, the inset material being sufficiently pliable to be easily pierced by the nose of the dart and sufficiently resilient to grip the nose of the dart holding the dart in position within the block, the dart being inserted into the block with the nose received therein and with the shaft end adjacent the nose juxtaposed with said one inset surface.

* * * * *